US011980256B1

(12) United States Patent
Lu

(10) Patent No.: US 11,980,256 B1
(45) Date of Patent: May 14, 2024

(54) STRAP BUCKLE

(71) Applicant: RATCHET KING CO., LTD., Taichung (TW)

(72) Inventor: Jung-Wen Lu, Taichung (TW)

(73) Assignee: RATCHET KING CO., LTD., Taichung (TW)

( * ) Notice: Subject to any disclaimer, the term of this patent is extended or adjusted under 35 U.S.C. 154(b) by 0 days.

(21) Appl. No.: 17/975,524

(22) Filed: Oct. 27, 2022

(51) Int. Cl.
*A44B 11/12* (2006.01)
*A44B 11/16* (2006.01)

(52) U.S. Cl.
CPC ..... *A44B 11/125* (2013.01); *A44B 11/16* (2013.01); *Y10T 24/21* (2015.01)

(58) Field of Classification Search
CPC ..... Y10T 24/21; B60P 7/083; B60P 7/0838; A44B 11/125; A44B 11/16
See application file for complete search history.

(56) References Cited

U.S. PATENT DOCUMENTS 3,099,055 A * 7/1963 Huber ..... B60P 7/0838 24/68 CD
6,158,092 A * 12/2000 Huang ..... B60P 7/0838 24/68 CD
6,499,197 B1 * 12/2002 Huang ..... A44B 11/125 24/71 ST
6,547,218 B2 * 4/2003 Landy ..... B60P 7/083 24/68 CD
11,313,437 B1 * 4/2022 Williams ..... B60P 7/083
2005/0283951 A1 * 12/2005 Chang ..... A44B 11/125 24/68 CD

FOREIGN PATENT DOCUMENTS

TW 486048 5/2002
TW M469266 1/2014

* cited by examiner

*Primary Examiner* — Victor D Batson
*Assistant Examiner* — Michael S Lee
(74) *Attorney, Agent, or Firm* — MUNCY, GEISSLER, OLDS & LOWE, PC

(57) ABSTRACT

A strap buckle has a base. The base has a bottom plate and two side plates each having one end formed with a pivot hole. The base has a retaining portion spaced from the bottom plate. An opening is defined between the bottom plate and the retaining portion. A swinging member has a pivot portion pivotally connected to the pivot hole. Two opposite sides of the pivot portion have two perforations, respectively. Two transverse rods pass through the perforations and are arranged in parallel. The swinging member is pivoted relative to the base to drive the two transverse rods to rotate together. A pressing assembly has a pressing member and an elastic member. The pressing member is disposed between the two side plates of the base. A first strap is inserted between the bottom plate and the pressing member and wound around the two transverse rods.

6 Claims, 7 Drawing Sheets

STRAP BUCKLE

FIELD OF THE INVENTION

The present invention relates to a buckle, and more particularly to a strap buckle configured to tension a strap repeatedly for tying articles tightly.

BACKGROUND OF THE INVENTION

Generally, a rubber strap or a rope is used to tie and retain articles. However, the way of tying the rubber strap/rope may be different from person to person. The articles may fall off because they are not tied tightly.

Therefore, a ratchet buckle is developed on the market. U.S. Pat. No. 6,547,218 discloses a ratchet strap apparatus, including a first strap adapted to be selectively tensioned and a second strap adapted to be secured to the apparatus. A pressing block is pressed against the second strap. When in use, the user holds the handle of the ratchet strap apparatus to swing it back and forth. Articles can be tied tightly through a one-way ratchet mechanism. However, when the strap is loosened to be rolled up, the strap is easily stuck on the ratchet strap apparatus because of the strong pressing force of the ratchet, resulting in inconsistencies in the use and arrangement. In addition, the structure of the ratchet strap apparatus is complex. It is not easy to manufacture the ratchet strap apparatus, so the manufacturing cost cannot be reduced effectively. In addition, the pressing block is configured to press against the second strap. The length of the second strap can be adjusted by releasing the pressing block, so the pressing block has no effect on the first strap to be tensioned.

The strap buckle disclosed in Taiwan Utility Mode Registration No. M469266 and 486048 has a standard fixing method of use. There is no need to provide a ratchet for tensioning the strap to tie articles. However, the strap of the strap buckle can be tensioned only one time after being retained. The strap cannot be tensioned repeatedly like a ratchet buckle, so it cannot improve the tying effect.

SUMMARY OF THE INVENTION

The primary object of the present invention is to provide a strap buckle that is used to tension a strap repeatedly. The strap buckle includes a swinging member to be pivoted back and forth and a pressing member to restrict movement of the strap. There is no need to provide a ratchet for tensioning the strap to tie articles. The structure of the strap buckle is relatively simple. The strap buckle has the advantages of easy manufacture and cost reduction.

In order to achieve the object, a strap buckle provided by the present invention comprises a base, a swinging member, a pressing assembly, and a first strap.

The base has a bottom plate and two side plates on two opposite sides of the bottom plate. The two side plates each have one end formed with a pivot hole and a middle portion formed with a through hole. The base further has a retaining portion that is spaced from the bottom plate and located at one end of the bottom plate away from the pivot hole. An opening is defined between the bottom plate and the retaining portion.

The swinging member has a pivot portion. The pivot portion of the swinging member is pivotally connected to the pivot hole. Two opposite sides of the pivot portion have two perforations, respectively. Two transverse rods pass through the perforations of the two opposite sides of the pivot portion and are arranged in parallel. The swinging member is pivoted relative to the base to drive the two transverse rods to rotate together.

The pressing assembly includes a pressing member and an elastic member that is elastically pressed against a bottom of the pressing member. The pressing member has a connecting portion. The connecting portion is formed with an aperture transversely passing through the connecting portion. An insertion rod passes through the through hole, the aperture and the elastic member to connect the pressing member between the two side plates of the base. The pressing member has a toothed surface facing the bottom plate on an outer periphery of the connecting portion.

The first strap is inserted between the bottom plate and the pressing member from the opening and wound around the two transverse rods.

The elastic member provides an elastic return force for the pressing member to press against the first strap on the base. The swinging member is pivoted back and forth between a first position and a second position. When the swinging member is pivoted from the first position to the second position relative to the base, the swinging member drives the two transverse rods to rotate eccentrically to pull the first strap wound around the two transverse rods to move. When the swinging member is pivoted from the second position to the first position relative to the base, the pressing member restricts movement of the first strap so that the first strap is not rotated by the swinging member.

DETAILED DESCRIPTION OF THE PREFERRED EMBODIMENTS

Figure 1:
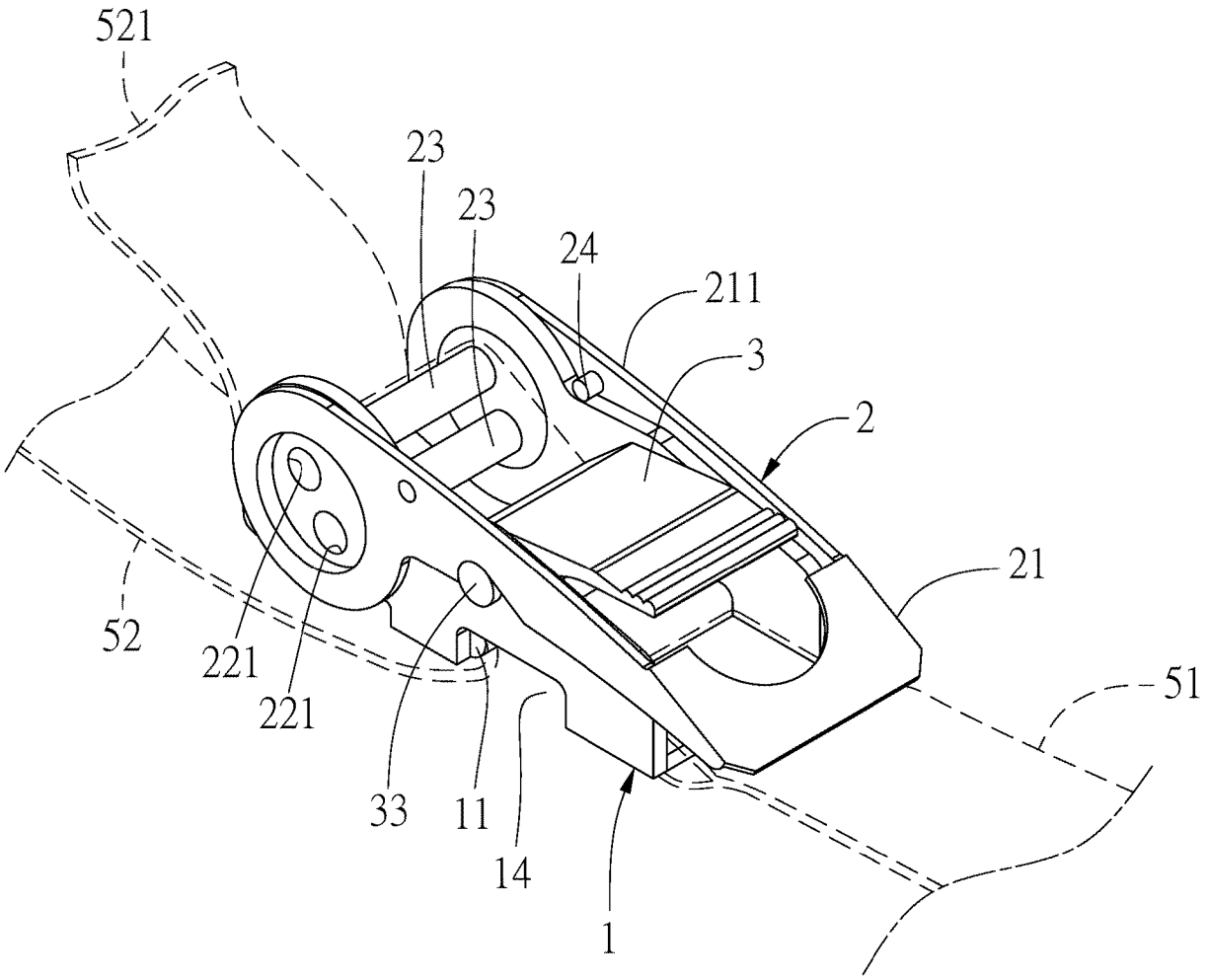
FIG. 1 is a perspective view of a first embodiment of the present invention.
Figure 2:
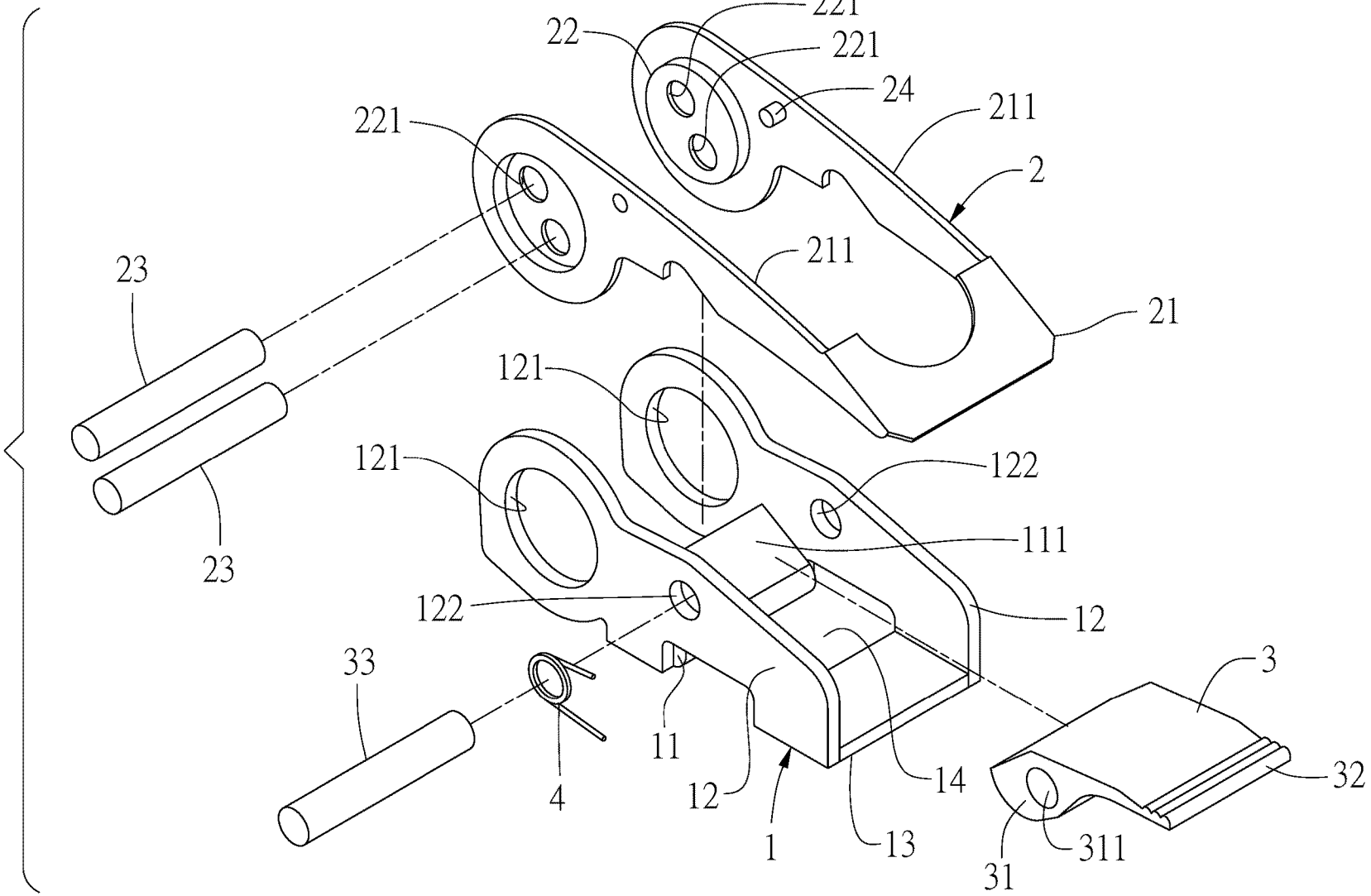
FIG. 2 is an exploded view of the first embodiment of the present invention.

Referring to FIGS. 1 to 5, a strap buckle of a first embodiment of the present invention is composed of a tensioning mechanism and a first strap 52. The tensioning mechanism comprises a base 1, a swinging member 2 and a pressing assembly.

The base 1 has a bottom plate 11 and two side plates 12 on two opposite sides of the bottom plate 11. The two side plates 12 each has one end formed with a circular pivot hole 121 and a middle portion formed with a through hole 122. The base 1 further has a retaining portion 13 that is spaced from the bottom plate 11 and located at one end of the bottom plate 11 away from the pivot hole 121. An opening 14 is defined between the bottom plate 11 and the retaining portion 13. In this embodiment, the bottom plate 11 has an inclined plane 111 that is inclined upward toward the pivot hole 121.

The swinging member 2 has a grip portion 21 and a pivot portion 22. The pivot portion 22 of the swinging member 2 is pivotally connected to the pivot hole 121. Two opposite sides of the pivot portion 22 has two perforations 221, respectively. Two cylindrical transverse rods 23 pass through the perforations 221 of the two opposite sides of the pivot portion 22 and are arranged in parallel. The transverse rods 23 correspond in shape to the perforations 221 to be matched with each other. When the swinging member 2 is pivoted relative to the base 1, the swinging member 2 can drive the two transverse rods 23 to rotate together. In the first embodiment, two opposite sides of the grip portion 21 extend in the same direction to form a pair of wing plates 21. Two opposite sides of extension ends of the wing plates 211 protrude inwardly to form the pivot portion 22. The shape of the outer periphery of the pivot portion 22 is consistent with the shape of the inner periphery of the pivot hole 121. The pivot portion 22 of the swinging member 2 is pivotally connected to the pivot holes 121 of the two side plates 12 of the base 1 from the outer sides of the two side plates 12. The swinging member 2 can be pivoted back and forth relative to the base 1 between a first position P1 where the swinging member 2 is closed relative to the base 1 and a second position P2 where the swinging member 2 is opened relative to the base 1.

The pressing assembly includes a pressing member 3 and an elastic member 4. The pressing member 3 has a connecting portion 31 at one end and a pressing portion 32 at an opposing end thereof. The connecting portion 31 is formed with an aperture 311 transversely passing through the connecting portion 31. One end of the elastic member 4 is pressed against the bottom of the pressing member 3, and the other end of the elastic member 4 is pressed against the retaining portion 13. In this embodiment, the elastic member 4 is a torsion spring. The elastic member 4 may be a member with elastic force, such as a compression spring or a leaf spring, but not limited thereto. An insertion rod 33 passes through the through hole 122, the aperture 311 and the elastic member 4 to connect the pressing member 3 between the two side plates 12 of the base 1. The pressing member 3 has a toothed surface 312 facing the bottom plate 11 on the outer periphery of the connecting portion 31. The toothed surface 312 has a plurality of teeth arranged at equal intervals.

Furthermore, at least one side of the swinging member 2 has a raised portion 24 that protrudes inwardly and is located adjacent to the pivot portion 22. When the swinging member 2 is pivoted to the first position P1 or the second position P2, the raised portion 24 abuts against the outer periphery of the base 1, so as to prevent the swinging member 2 from pivoting excessively.

Figure 3:
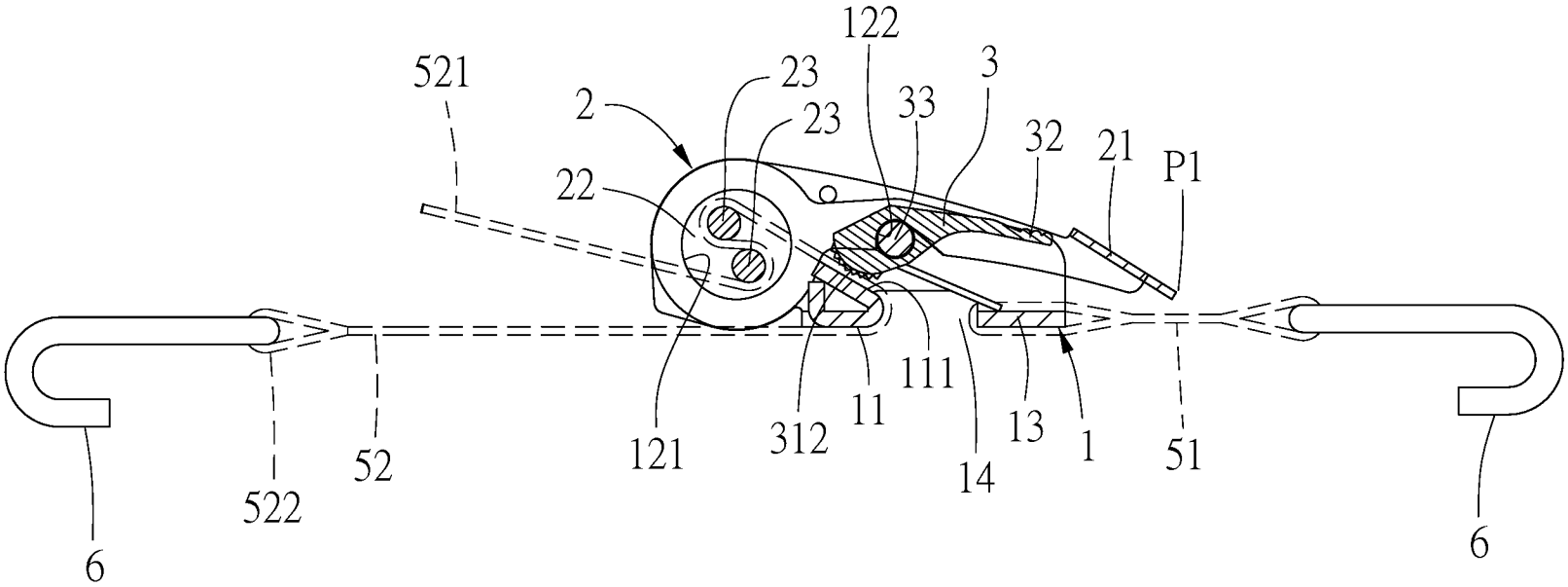
FIG. 3 is a schematic view of the first embodiment of the present invention when in use.

The first strap 52 is made of a soft material, and has a movable end 521 and a hook end 522 opposite to the movable end 521. The movable end 521 of the first strap 52 is inserted between the inclined plane 111 of the bottom plate 11 and the pressing member 3 from the opening 14 and wound around the two transverse rods 23 in an S shape. The hook end 522 is wound and connected to a hook 6 by sewing (as shown in FIG. 3). The elastic member 4 provides an elastic return force for the toothed surface 312 of the pressing member 3 to press against the first strap 52 on the inclined plane 111, so as to restrict the movement of the first strap 52. The inclined plane 111 of the present invention may be changed to a horizontal plane for the toothed surface 312 of the pressing member 3 to press against the first strap 52, which also achieves the function to restrict the movement of the first strap 52.

In this embodiment, a retaining member is further provided. The retaining member is wound around the retaining portion 13 of the base 1 for connecting a hook 6. In this embodiment, the retaining member is also made of a soft material. The retaining member is a second strap 51 (as shown in FIG. 3). One end of the second strap 51 is wound and connected to the retaining portion 13 of the base 1 by sewing, and the other end of the second strap 51 is wound and connected to another hook 6.

When in use, the present invention is applied to tying articles. Please refer to FIGS. 3 to 5. The user first secure the hooks 6 wound around the second strap 51 and the first strap 52 at appropriate positions respectively. Then, the pressing portion 32 of the pressing member 3 is pressed toward the base 1 to form a gap sufficient for the first strap 52 to be inserted between the inclined plane 111 of the bottom plate 11 and the pressing member 3. As shown in FIG. 3, the movable end 521 of the first strap 52 can be inserted in the opening 14 to pass through the opening between the inclined plane 111 of the bottom plate 11 and the pressing member 3 to be wound around the two transverse rods 23 in an S shape.

Figure 4:
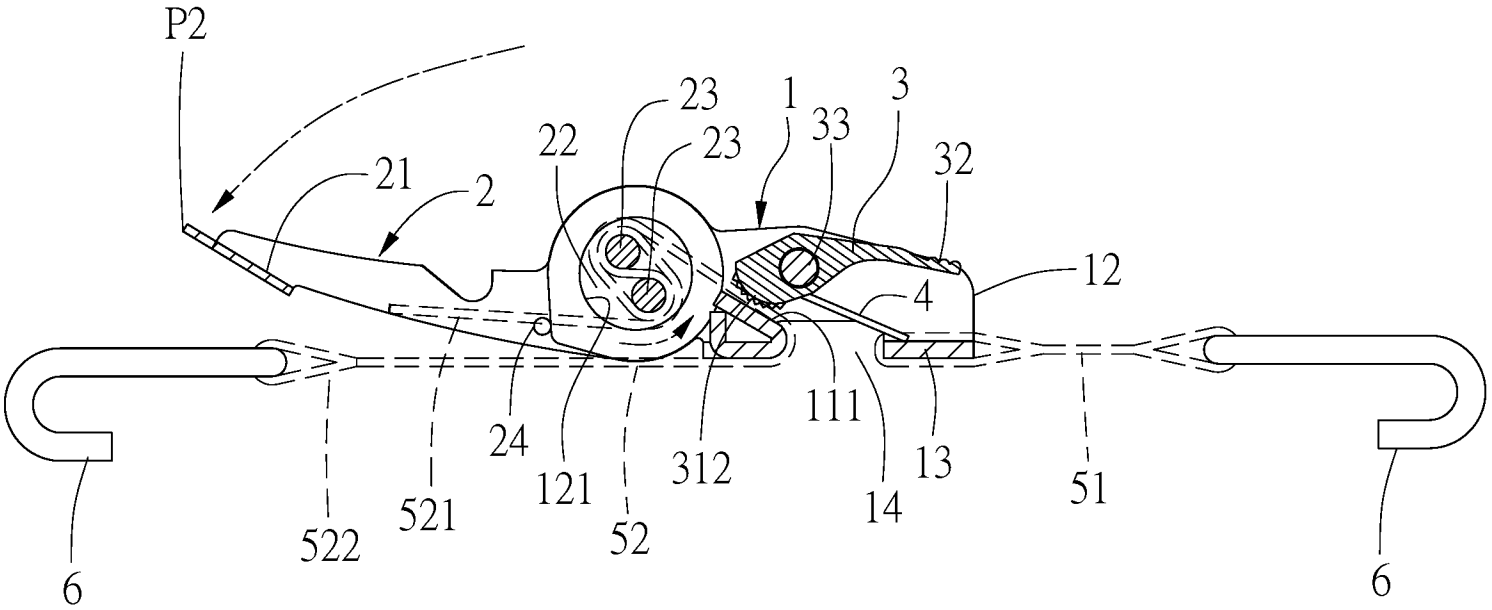
FIG. 4 and FIG. 5 are schematic views showing the operation of the first embodiment of the present invention when in use.

As shown in FIG. 4, when the user applies a rotational force to the grip portion 21 of the swinging member 2, the swinging member 2 is pivoted from the first position P1 to the second position P2 relative to the base 1, and the swinging member 2 drives the two transverse rods 23 to rotate eccentrically. Since the rotational force is greater than the elastic return force of the elastic member 4, when the two transverse rods 23 are rotated eccentrically, the pressing force of the pressing member 3 against the first strap 52 is not enough to restrict the movement of the first strap 52, so as to pull the first strap 52 wound around the two transverse rods 23 to move forward. The hook end 522 is moved toward the base 1 to shorten the distance between the hook end 522 and the base 1, thereby tying the articles tightly.

Figure 5:
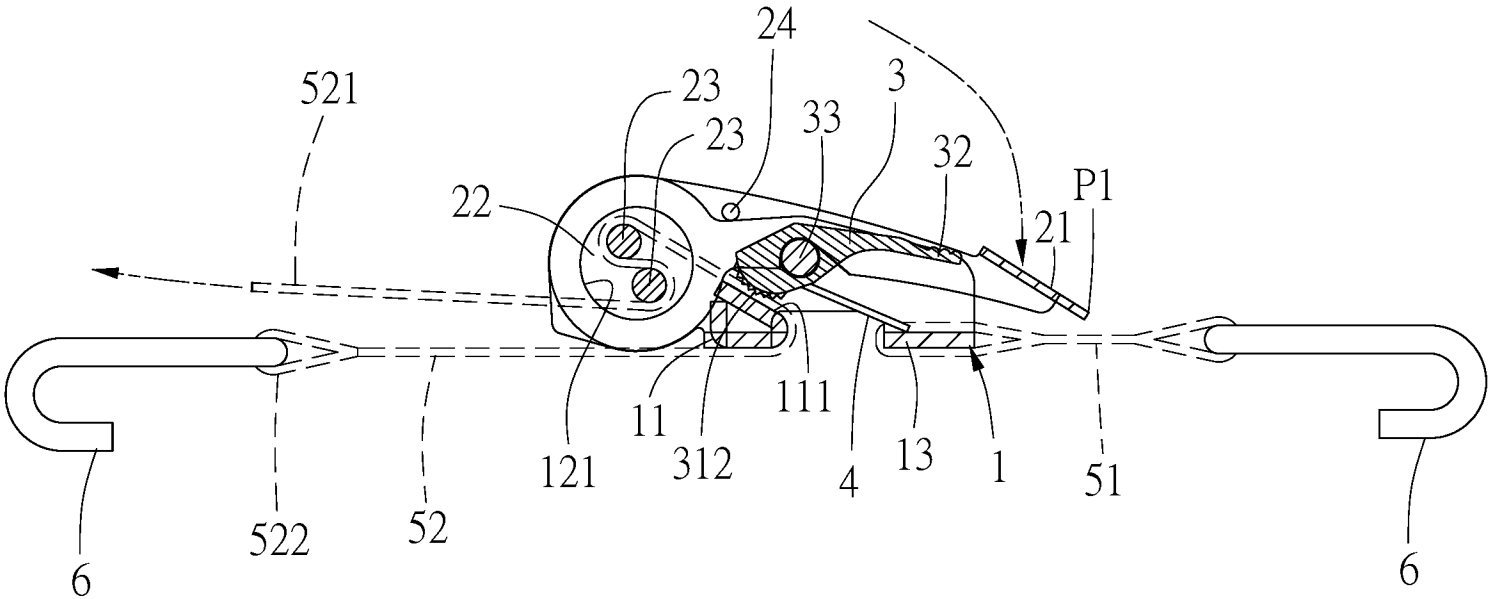

As shown in FIG. 5, when the swinging member 2 is pivoted from the second position P2 to the first position P1 relative to the base 1, the pressing member 3 is pressed against the first strap 52 by the elastic return force of the elastic member 4, thereby restricting the movement of the first strap 52. The first strap 52 is not rotated by the swinging member 2, so as to keep the force after being tensioned. Then, an external force is exerted to pull out the redundant first strap 52 wound around the two transverse rods 23 to complete the return operation. The operations shown in FIG. 4 and FIG. 5 are repeated to tie the articles tightly.

In the present invention, the bottom plate 11 has the inclined plane 111 that is inclined upward. The inclination angle of the inclined plane 111 is equal to the inclination angle of the first strap 52 after being tensioned, so that the first strap 52 wound around the two transverse rods 23 can be moved straight along the inclined plane 111. This can avoid excessive bending to affect the movement of the first strap 52.

Furthermore, because the two transverse rods 23 are cylindrical, the two transverse rods 23 can pull the first strap 52 with their smooth surfaces, thereby improving the smoothness of pulling. Besides, it is easy to manufacture the cylindrical transverse rods 23 in the manufacturing process, so as to reduce the manufacturing cost.

The pressing member 3 presses against the first strap 52 with its toothed surface 312 on the outer periphery of the connecting portion 31. Because the first strap 52 is made of a soft material, the teeth on the toothed surface 312 are engaged with the surface of the first strap 52, thereby enhancing the tying strength between the pressing member 3 and the first strap 52.

According to the above description, when the swinging member 2 is pivoted from the first position P1 to the second position P2 relative to the base 1, the first strap 52 can be moved forward to tie the articles tightly. When the swinging member 2 is pivoted from the second position P2 to the first position P1 relative to the base 1, the movement of the first strap 52 is restricted by the pressing member 3, so as to keep the force after being tensioned. Accordingly, when the swinging member 2 is pivoted repeatedly in the above-mentioned manner, the function of one-way engagement like a ratchet can be achieved to tie the articles tightly, thereby improving the firmness of tying the articles effectively. There is no need to provide a ratchet for tensioning the strap to tie the articles. The structure of the present invention is relatively simple. The present invention has the effects of easy manufacture and cost reduction.

Figure 6:
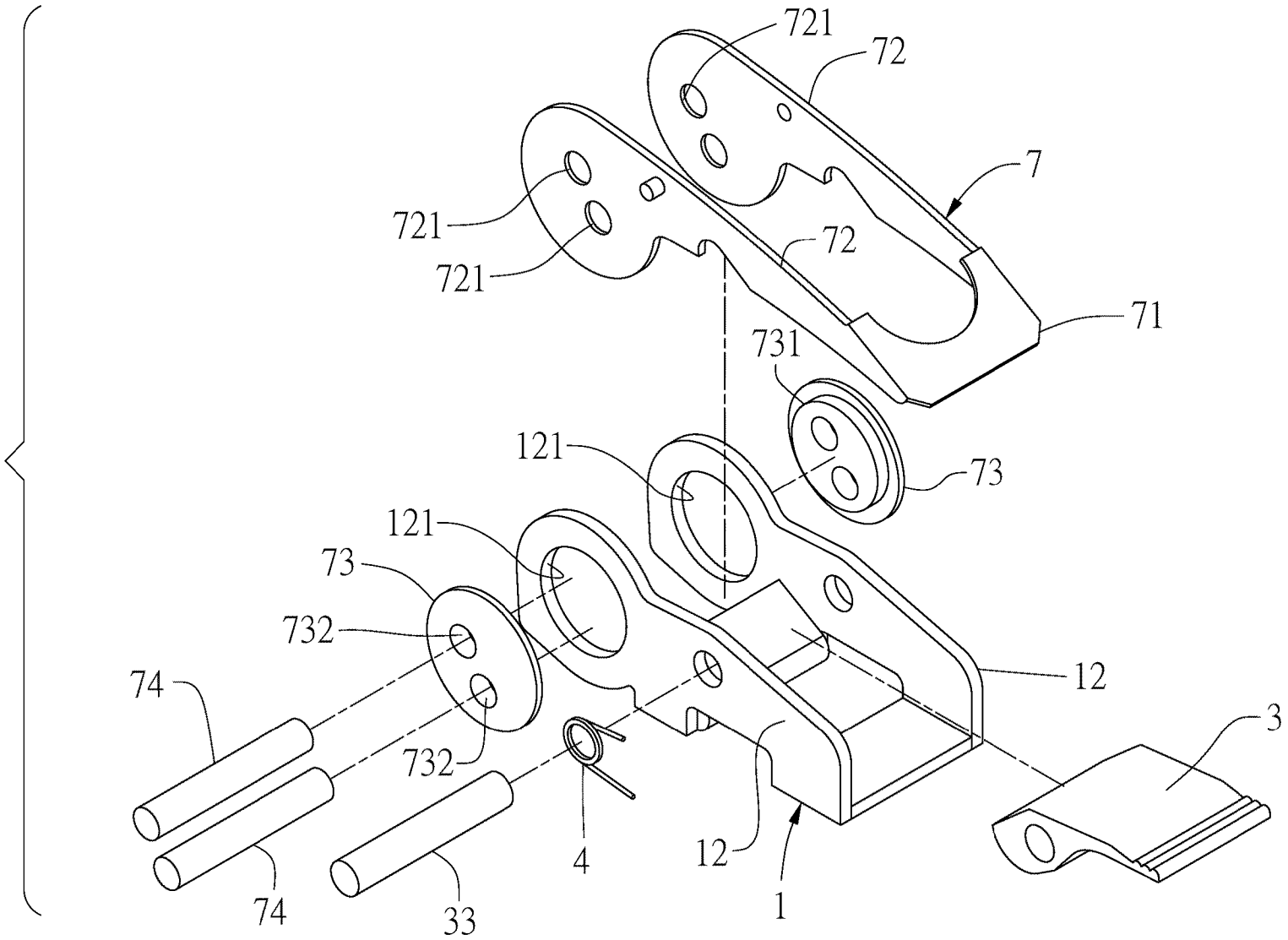
FIG. 6 is an exploded view of a second embodiment of the present invention.
Figure 7:
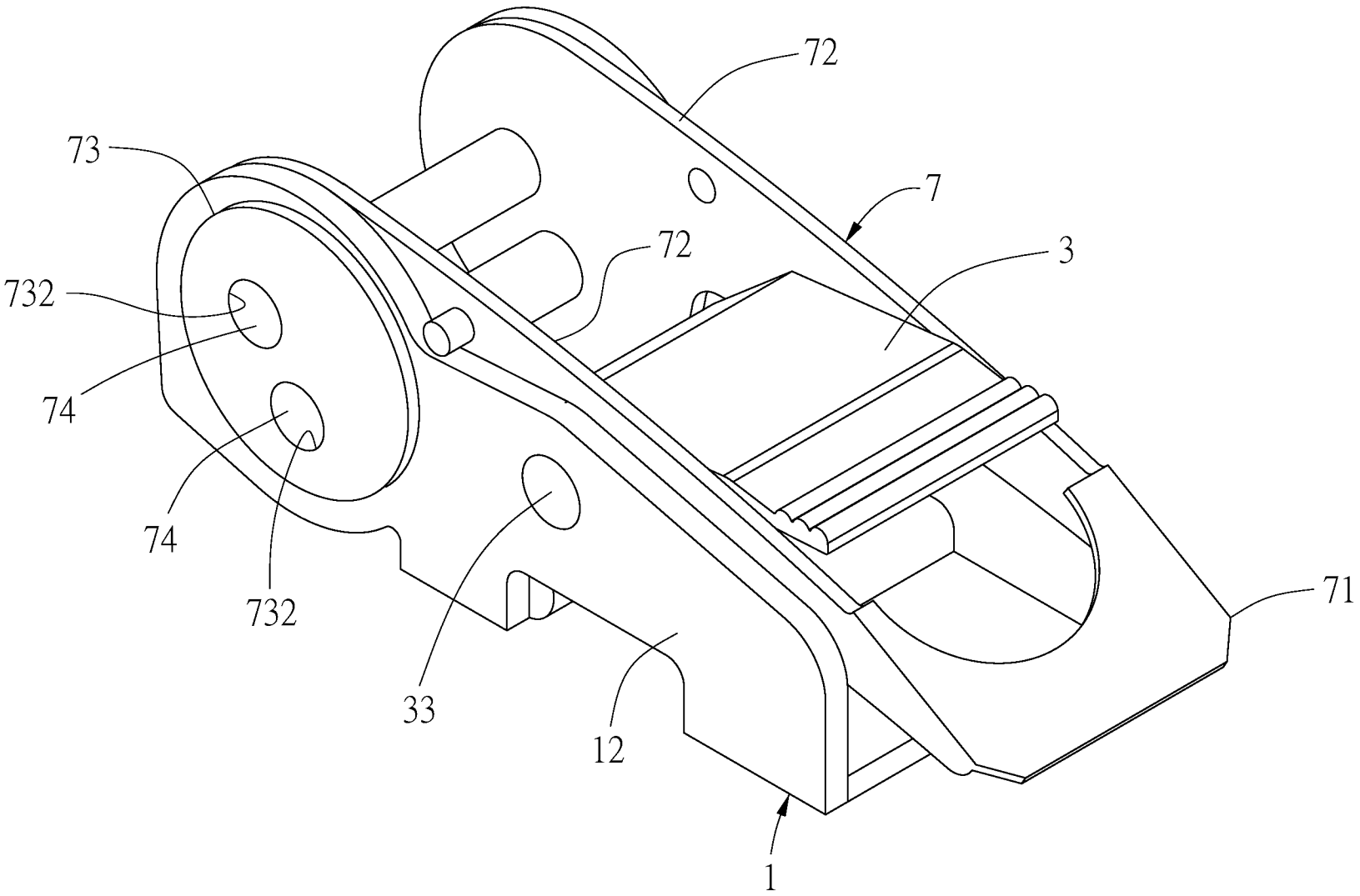
FIG. 7 is a perspective view of the second embodiment of the present invention.

FIG. 6 and FIG. 7 illustrate a second embodiment of the present invention. The second embodiment is substantially similar to the first embodiment with the exceptions described below. Two opposite sides of the grip portion 71 of the swinging member 7 extend in the same direction to form a pair of wing plates 72. Two holes 721 are defined in an extension end of each wing plate 72. The wing plates 72 are adjacent to the inner sides of the two side plates 12 and located in the base 1, respectively. The swinging member 7 further includes two connecting members 73. Each connecting member 73 has a flange protruding from one side thereof to form the pivot portion 731. The two connecting members 73 are pivotally connected to the base 1 with their flanges fitted in the corresponding pivot holes 121 from the outer sides of the two side plates 12. The two cylindrical transverse rods 74 are inserted through the perforations 732 of the pivot portions 731 of the connecting members 73 and the holes 721 aligned with the perforations 732. The two cylindrical transverse rods 74 are arranged in parallel. The swinging member 7 is pivotally connected to the base 1 through the two connecting members 73, so as to achieve the function to be pivoted back and forth. The swinging member 7 has the same effect as the first embodiment.

What is claimed is:

1. A strap buckle, comprising:

a base, having a bottom plate and two side plates on two opposite sides of the bottom plate, the two side plates each having one end formed with a pivot hole and a middle portion formed with a through hole, the base further having a retaining portion that is spaced from the bottom plate and located at one end of the bottom plate away from the pivot hole, an opening being defined between the bottom plate and the retaining portion;

a swinging member, having a pivot portion, the pivot portion of the swinging member being pivotally connected to the pivot hole, two opposite sides of the pivot portion having two perforations respectively, two transverse rods passing through the perforations of the two opposite sides of the pivot portion and being arranged in parallel, the swinging member being pivoted relative to the base to drive the two transverse rods to rotate together;

a pressing assembly, including a pressing member and an elastic member that is elastically pressed against a bottom of the pressing member, the pressing member having a connecting portion, the connecting portion being formed with an aperture transversely passing through the connecting portion, an insertion rod passing through the through hole, the aperture and the elastic member to connect the pressing member between the two side plates of the base, the pressing member having a toothed surface facing the bottom plate on an outer periphery of the connecting portion;

a first strap, the first strap being inserted between the bottom plate and the pressing member from the opening and wound around the two transverse rods;

wherein the elastic member provides an elastic return force for the pressing member to press against the first strap on the base, the swinging member is pivoted back and forth between a first position and a second position; when the swinging member is pivoted from the first position to the second position relative to the base, the swinging member drives the two transverse rods to rotate eccentrically for pulling the first strap wound around the two transverse rods to move; when the swinging member is pivoted from the second position to the first position relative to the base, the pressing member restricts movement of the first strap so that the first strap is not rotated by the swinging member;

wherein the swinging member further has a grip portion, two opposite sides of the grip portion extend in a same direction to form a pair of wing plates, two opposite sides of extension ends of the wing plates protrude inwardly to form the pivot portion, and the pivot portion of the swinging member is pivotally connected to the corresponding pivot holes of the two side plates of the base from outer sides of the two side plates;

wherein the pivot portion is formed by protruding inward at the respective ends of the pair of wing plates, and the two perforations are directly created on the pivot portion for the insertion of the two transverse rods, the swinging member pivots relative to the base to synchronously drive the two transverse rods to rotate around the pivot axis of the pivot portions.

2. The strap buckle as claimed in claim 1, wherein the swinging member further has a grip portion, two opposite sides of the grip portion extend in a same direction to form a pair of wing plates, two holes are defined in an extension end of each of the wing plates, the wing plates are adjacent to inner sides of the two side plates and located in the base respectively, the swinging member further includes two connecting members, each of the connecting member has a flange protruding from one side thereof to form the pivot portion, and the two connecting members are pivotally connected to the base with the flanges fitted in the corresponding pivot holes from outer sides of the two side plates.

3. The strap buckle as claimed in claim 1, wherein the bottom plate has an inclined plane that is inclined upward toward the pivot hole, and the inclined plane has an inclination angle equal to that of the first strap after being tensioned.

4. The strap buckle as claimed in claim 1, wherein at least one side of the swinging member has a raised portion adjacent to the pivot portion, when the swinging member is pivoted to the first position or the second position, the raised portion abuts against an outer periphery of the base.

5. The strap buckle as claimed in claim 1, wherein the elastic member is a compression spring.

6. The strap buckle as claimed in claim 1, further comprising a retaining member, the retaining member being wound around the retaining portion of the base for connecting a hook.

* * * * *